US011571798B2

(12) United States Patent
Statman et al.

(10) Patent No.: US 11,571,798 B2
(45) Date of Patent: Feb. 7, 2023

(54) MULTI-FUNCTION TOOL

(71) Applicant: Bluntool LLC, Los Angeles, CA (US)

(72) Inventors: Louis Statman, Austin, TX (US); James Michael Shoemaker, Los Angeles, CA (US)

(73) Assignee: Bluntool LLC, Los Angeles, CA (US)

( * ) Notice: Subject to any disclaimer, the term of this patent is extended or adjusted under 35 U.S.C. 154(b) by 0 days.

(21) Appl. No.: 15/929,947

(22) Filed: May 29, 2020

(65) Prior Publication Data

US 2020/0376643 A1 Dec. 3, 2020

Related U.S. Application Data

(60) Provisional application No. 62/854,136, filed on May 29, 2019.

(51) Int. Cl.
*B25F 1/00* (2006.01)
*B25B 13/06* (2006.01)

(52) U.S. Cl.
CPC ..... *B25F 1/00* (2013.01); *B25B 13/06* (2013.01)

(58) Field of Classification Search
CPC . B25F 1/00; B25B 13/06; B25B 13/48; B25B 15/008; B26B 11/00; B26B 23/007; B25G 1/08
USPC ..... 7/158, 138; 81/124.2, 119, 121.1, 124.1
See application file for complete search history.

(56) References Cited

U.S. PATENT DOCUMENTS 1,226,228 A 5/1917 Mckinzie
1,369,829 A 3/1921 Minges
1,434,401 A * 11/1922 Mueller ..... B25B 13/481 81/124.2
3,946,453 A 3/1976 Torres
4,607,547 A * 8/1986 Martus ..... B25B 23/105 81/53.2
4,774,736 A 10/1988 Brawner et al.
5,285,543 A 2/1994 Rowe
5,313,860 A 5/1994 Liou
5,588,169 A * 12/1996 Chuang ..... B25F 1/00 7/165
6,502,483 B1 * 1/2003 Swank ..... B25B 13/56 81/177.4

(Continued)

FOREIGN PATENT DOCUMENTS

CN 103862438 A * 6/2014 ..... B25F 1/003
WO 2019027740 A1 2/2019

OTHER PUBLICATIONS

International Search Report and Written Opinion of the International Searching Authority in connection with International Application No. PCT/US2020/035298 dated Aug. 27, 2020, 13 pages.

*Primary Examiner* — Anne M Kozak
*Assistant Examiner* — Tyler James McFarland
(74) *Attorney, Agent, or Firm* — Stephen Y. Liu; Carstens, Allen & Gourley, LLP

(57) ABSTRACT

A multi-function tool. The multi-function tool includes a first socket body having a first sidewall defining a first socket and a second socket, the first socket body being aligned with a first axis. The multi-function tool also includes a second socket body having a second sidewall defining a third socket, the second socket body being aligned with a second axis that is substantially parallel to the first axis. The first socket body is connected to the second socket body by a bridge.

17 Claims, 15 Drawing Sheets

(56) References Cited

U.S. PATENT DOCUMENTS

| | | | | |
|---|---|---|---|---|
| 7,293,312 | B2 | 11/2007 | Chmelar | |
| 7,698,970 | B1 | 4/2010 | Chavez et al. | |
| 9,289,891 | B1 | 3/2016 | Ragner | |
| 9,656,403 | B2 * | 5/2017 | Frazer | B25G 1/08 |
| D804,274 | S | 12/2017 | Tsai | |
| 2003/0110903 | A1 | 6/2003 | Creek | |
| 2005/0098000 | A1 | 5/2005 | Brooks | |
| 2006/0150340 | A1 | 7/2006 | Yale et al. | |
| 2007/0277652 | A1 | 12/2007 | Tuan-Mu | |
| 2011/0126677 | A1 | 6/2011 | Buchanan | |
| 2015/0135912 | A1 * | 5/2015 | Ma | B25B 13/06 81/437 |
| 2017/0021487 | A1 * | 1/2017 | Davis | B25B 13/48 |
| 2018/0215027 | A1 * | 8/2018 | Holm, Jr. | B25B 13/481 |

* cited by examiner

MULTI-FUNCTION TOOL

CROSS-REFERENCE TO RELATED APPLICATION AND CLAIM OF PRIORITY

This application claims priority under 35 U.S.C. § 119(e) to U.S. Provisional Patent Application No. 62/854,136 filed on May 29, 2019. The above-identified provisional patent application is hereby incorporated by reference in its entirety.

TECHNICAL FIELD

Various embodiments relate generally to multi-functional tools, and more particularly, to tools for use simple mechanical devices and with skateboards, in-line skates, quad skates, (BMX) bikes, and the like.

BACKGROUND

A skateboard is generally formed from a deck (i.e., a board) having four wheels mounted to the underside via skateboard trucks. Each skateboard truck includes a baseplate attached to a hanger by a kingpin fastened with a locknut. Wheels are mounted to opposite ends of the hanger by axle nuts, and the baseplate is mounted to an underside of the deck by mounting bolts and locknuts. Thus, the partial or complete assembly and disassembly of skateboards and other similar or conventionally available wheeled devices (e.g., roller skates, inline skates, quad skates, and bicycles) or even simple mechanical devices can require removal and replacement of various fasteners of various sizes.

SUMMARY

Novel aspects of this disclosure are directed to a multi-function tool for assembling and disassembling simple mechanical systems, such as skateboards and other conventional wheeled devices. In one embodiment, novel aspects provide for a multi-function tool. The multi-function tool includes a first socket body having a first sidewall defining a first socket and a second socket, the first socket body being aligned with a first axis. The multi-function tool also includes a second socket body having a second sidewall defining a third socket, the second socket body being aligned with a second axis that is substantially parallel to the first axis. The first socket body is connected to the second socket body by a bridge.

Other technical features may be readily apparent to one skilled in the art from the following figures, descriptions, and claims.

Before undertaking the DETAILED DESCRIPTION below, it may be advantageous to set forth definitions of certain words and phrases used throughout this patent document. The terms "include" and "comprise," as well as derivatives thereof, mean inclusion without limitation. The term "or" is inclusive, meaning and/or. The phrase "at least one of," when used with a list of items, means that different combinations of one or more of the listed items may be used, and only one item in the list may be needed. For example, "at least one of: A, B, and C" includes any of the following combinations: A, B, C, A and B, A and C, B and C, and A and B and C. Likewise, the term "set" means one or more. Accordingly, a set of items can be a single item or a collection of two or more items.

Definitions for other certain words and phrases are provided throughout this patent document. Those of ordinary skill in the art should understand that in many if not most instances, such definitions apply to prior as well as future uses of such defined words and phrases.

BRIEF DESCRIPTION OF THE DRAWINGS

For a more complete understanding of this disclosure and its advantages, reference is now made to the following description, taken in conjunction with the accompanying drawings, in which.

DETAILED DESCRIPTION

Figure 1A:
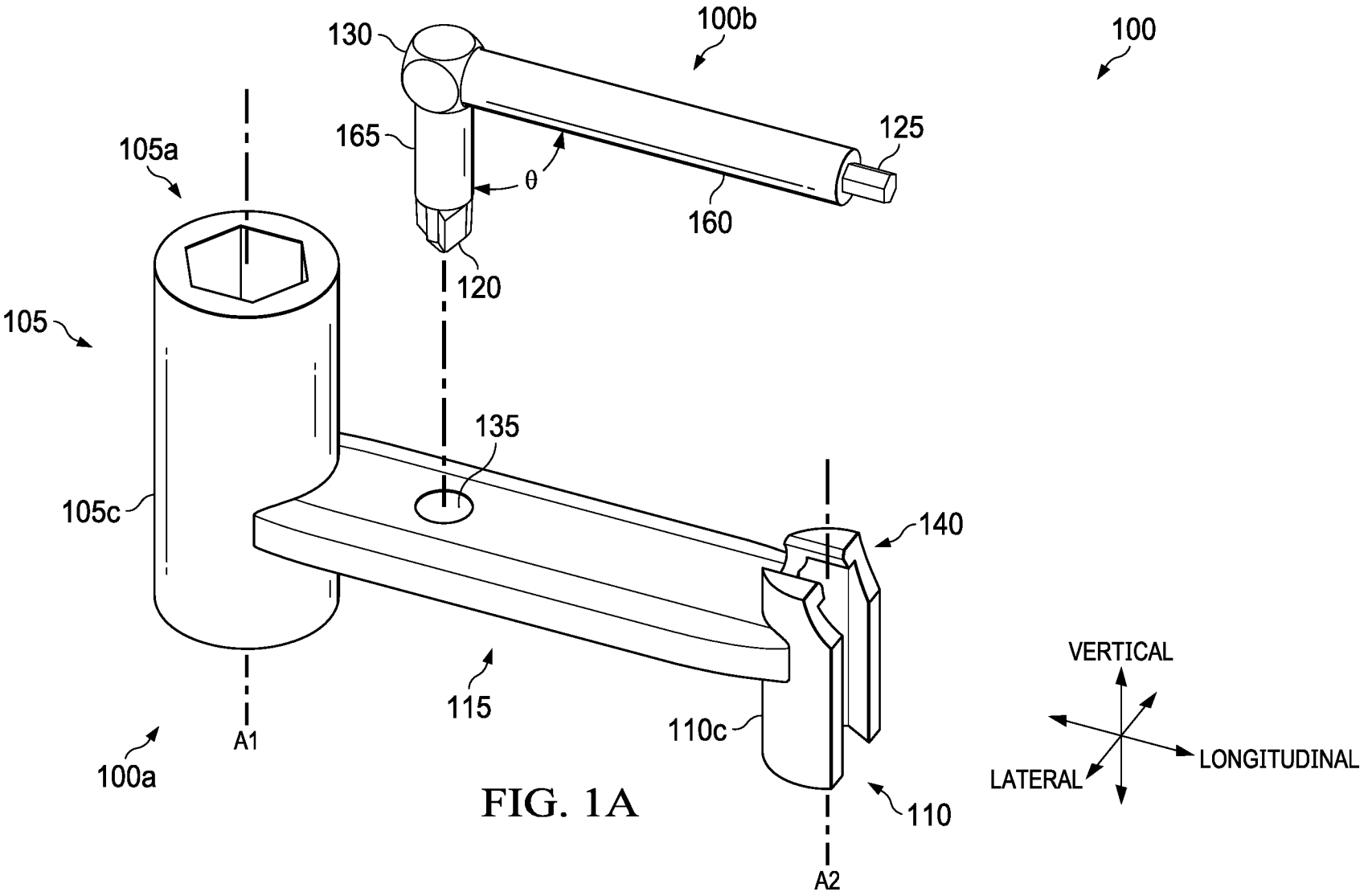
FIG. 1A illustrates a perspective view of the multi-function tool according to various embodiments of this disclosure.

The figures included herein, and the various embodiments used to describe the principles of the present disclosure are by way of illustration only and should not be construed in any way to limit the scope of the disclosure. Like reference numerals in the various drawings indicate like elements.

Novel aspects of the illustrative embodiments of the multi-function tool disclosed herein recognize the need for a compact tool that can be used to tighten or loosen the most common fasteners for simple mechanical devices, such as skateboards, bicycles, skates, and the like.

FIGS. 1A-1K illustrate different views of an exemplary multi-function tool according to various embodiments of this disclosure. The multi-function tool 100 includes a first tool 100*a* that can be removably coupled with a second tool 100*b* as described in more detail in the paragraphs that follow.

Figure 1B:
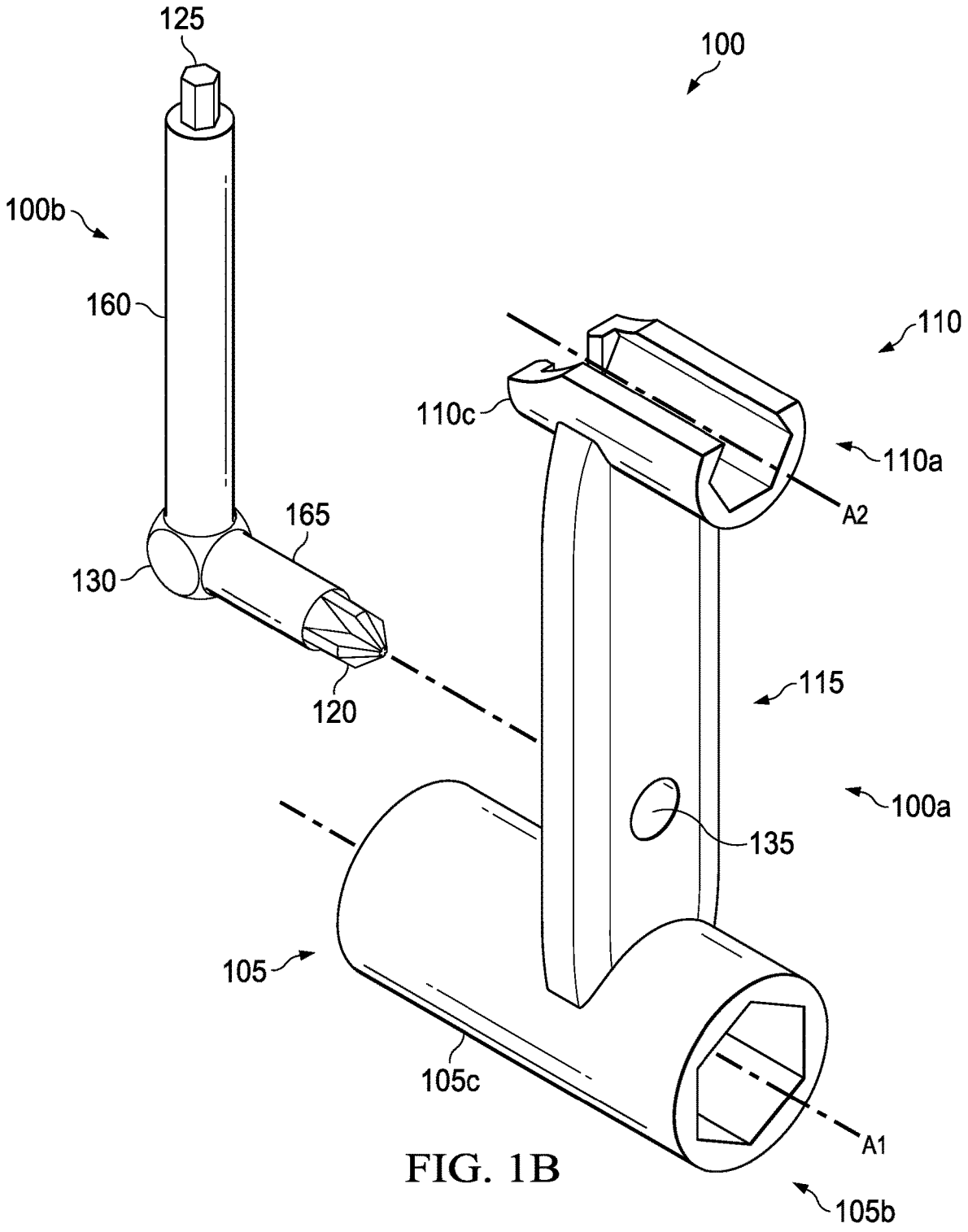
FIG. 1B illustrates another perspective view of the multi-function tool according to various embodiments of this disclosure.
Figure 1C:
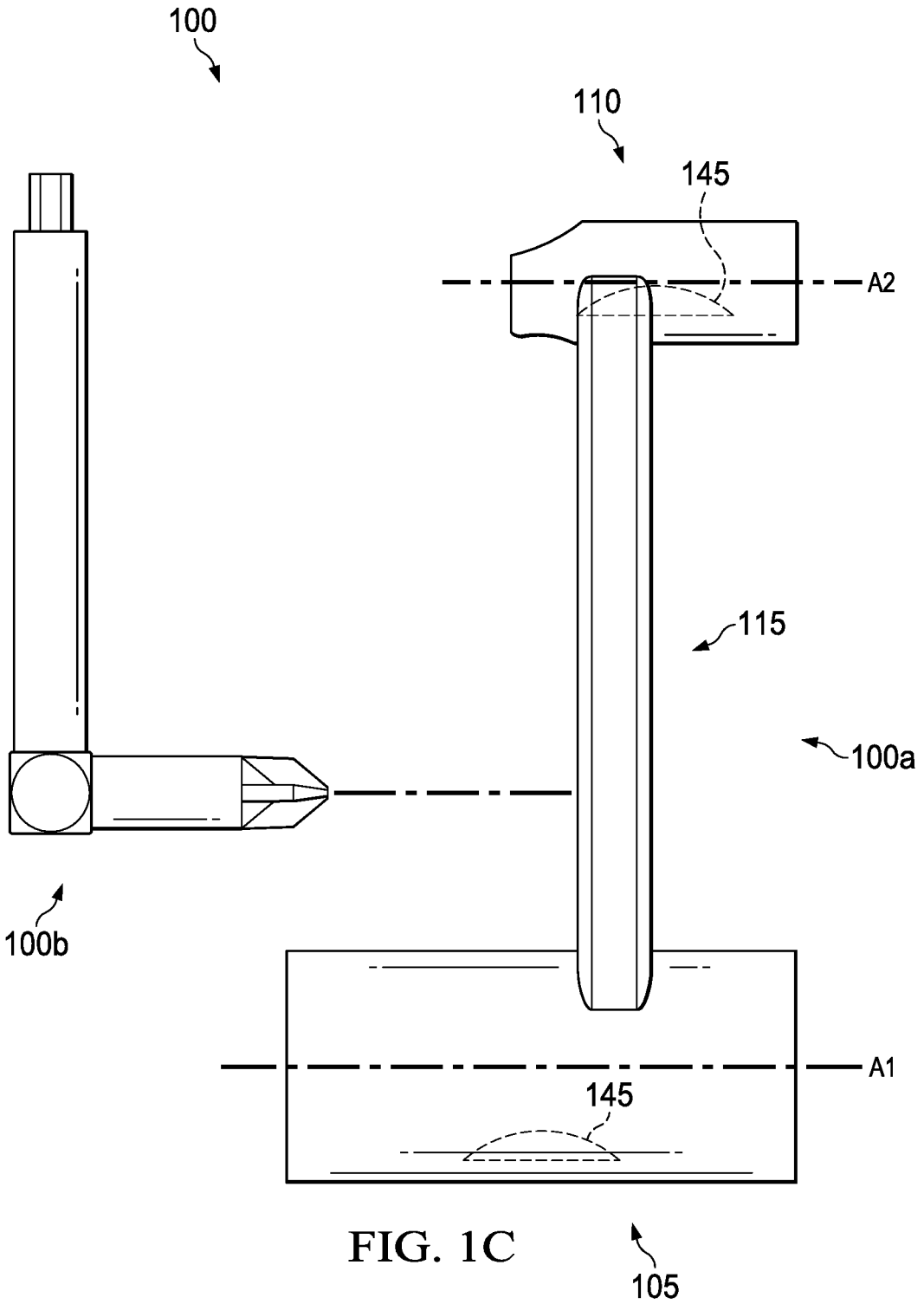
FIG. 1C illustrates a side view of the multi-function tool according to various embodiments of this disclosure.
Figure 1D:
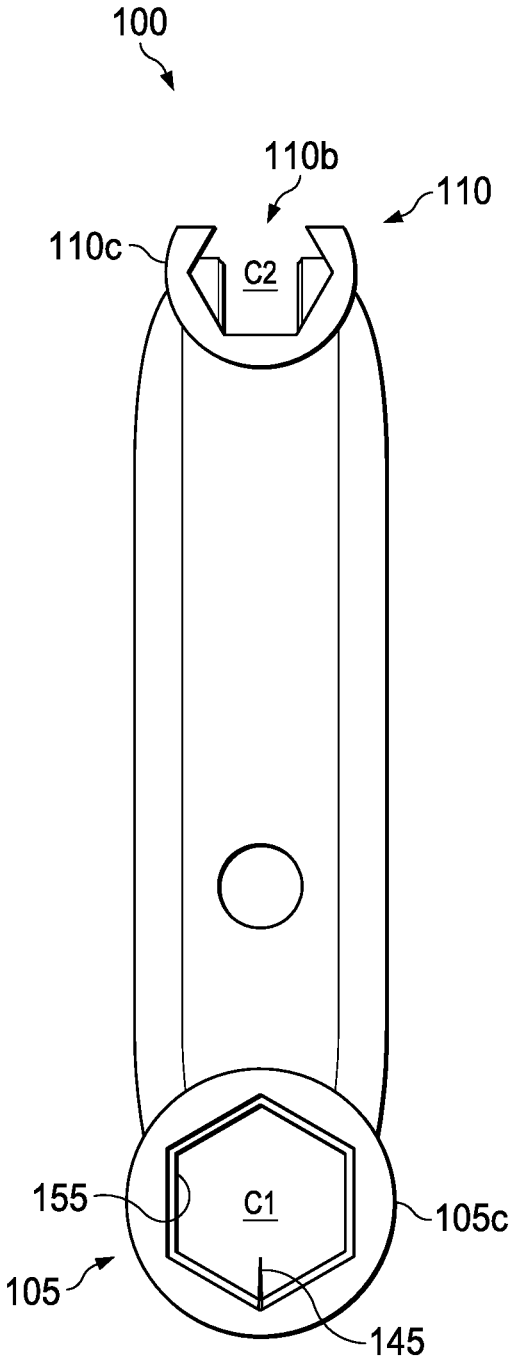
FIG. 1D illustrates a bottom view of the multi-function tool according to various embodiments of this disclosure.
Figure 1E:
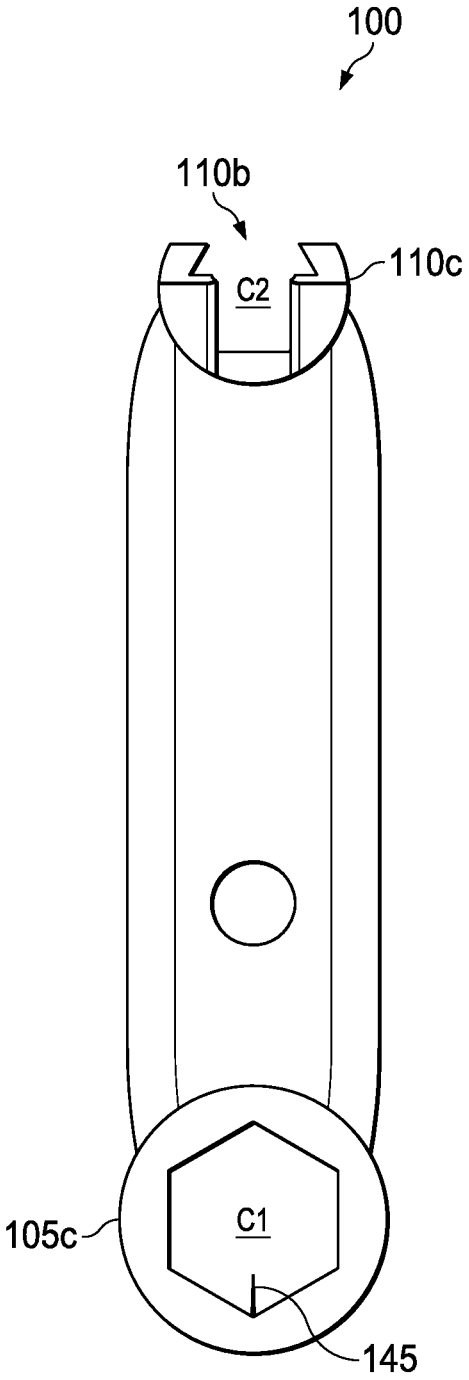
FIG. 1E illustrates a top view of the multi-function tool according to various embodiments of this disclosure.
Figure 1F:
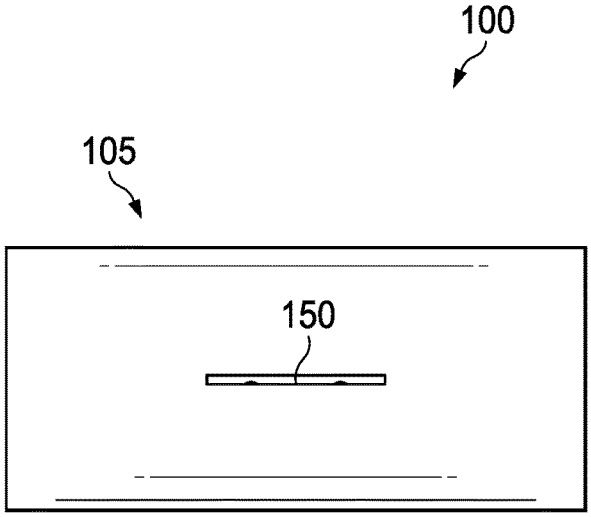
FIG. 1F illustrates an end view of the first socket body depicting a slot for receiving a blade according to various embodiments of this disclosure.
Figure 1G:
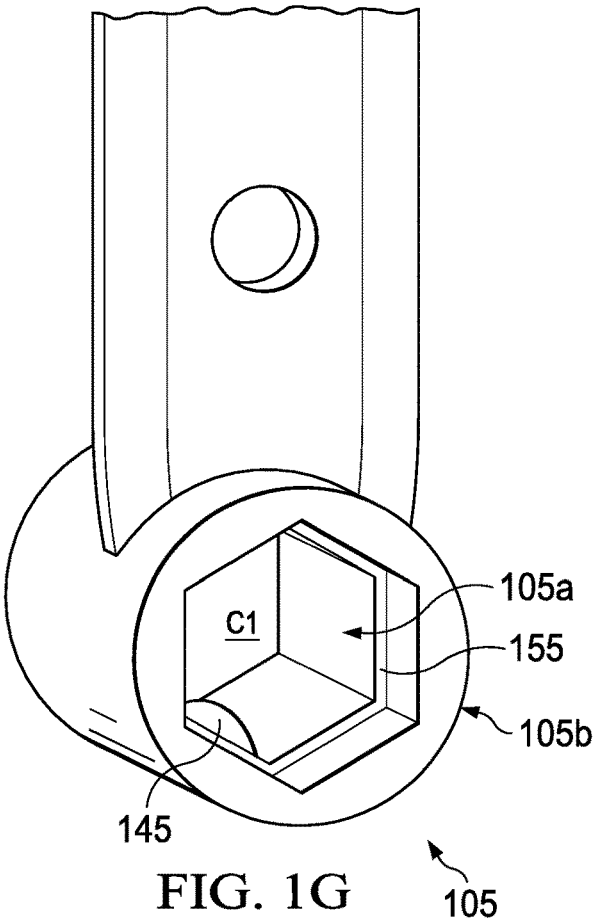
FIG. 1G illustrates a close-up perspective view depicting the first socket body according to various embodiments of this disclosure.
Figure 1H:
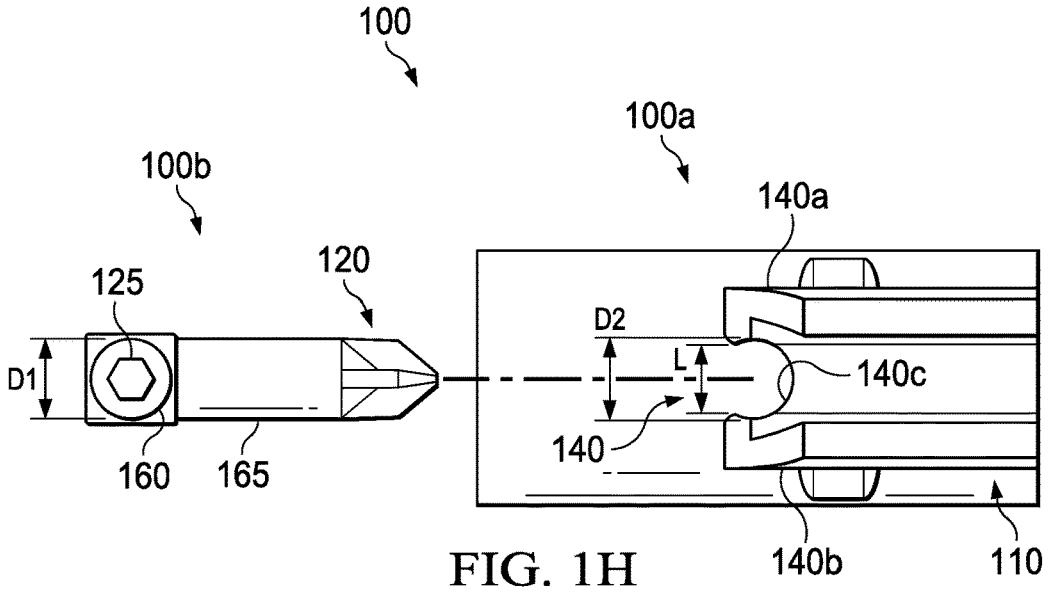
FIG. 1H illustrates an end view of the second socket body depicting a receiving slot and longitudinal gap according to various embodiments of this disclosure.
Figure 1I:
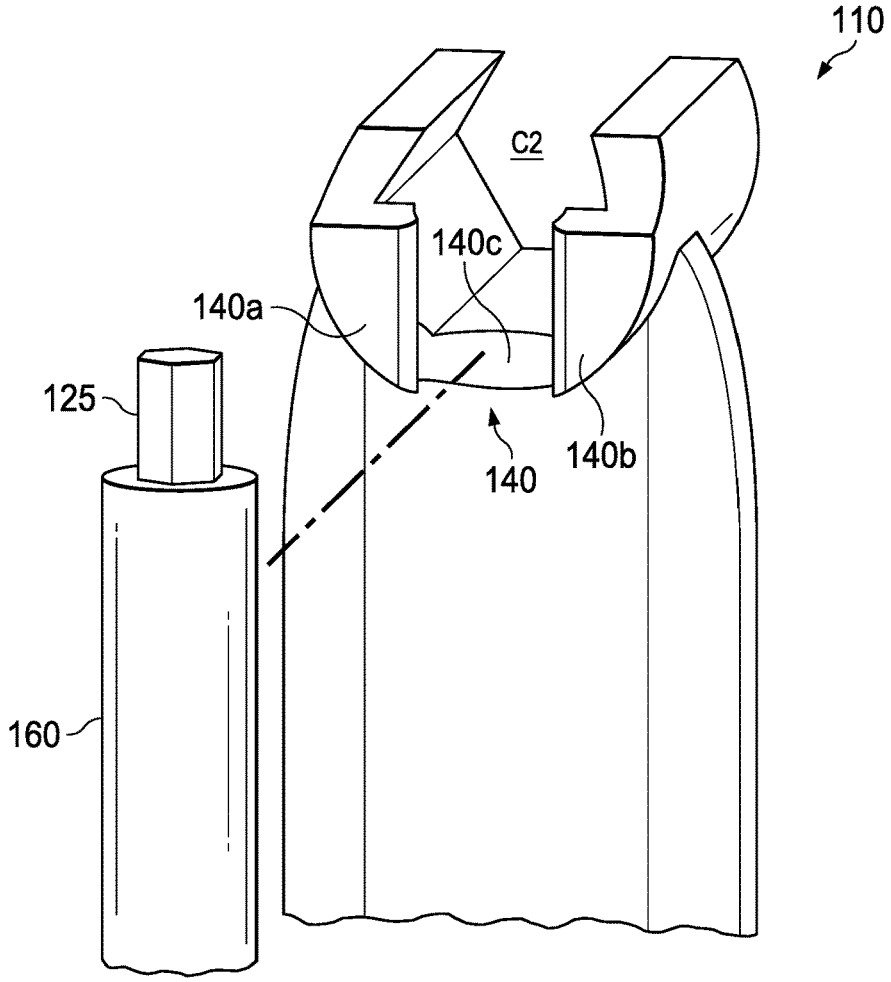
FIG. 1I illustrates a close-up perspective view depicting the second socket body according to various embodiments of this disclosure.
Figure 1J:
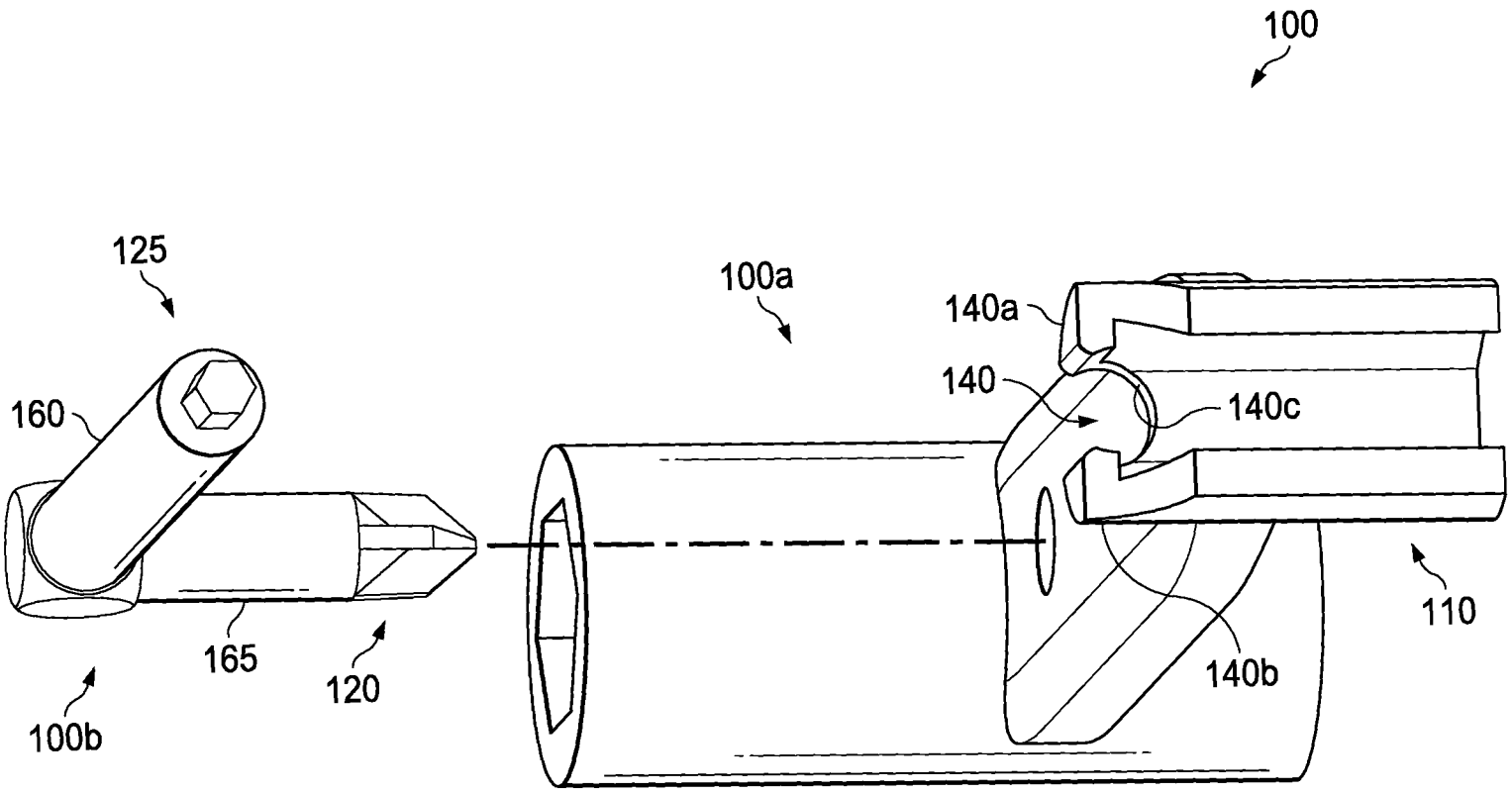
FIG. 1J illustrates another perspective view of the multi-function tool according to various embodiments of this disclosure.

FIGS. 1A, 1B, and 1J illustrate various perspective views of the multi-function tool in a disengaged configuration according to various embodiments of this disclosure. For ease of description, the view depicted in FIG. 1A will be referred to as a top perspective view and the view depicted in FIG. 1B will be referred to as the bottom perspective view.

The first tool 100*a* generally includes a first socket body 105 coupled to a second socket body 110 by an elongated bridge 115. The first socket body 105 includes a sidewall 105*c* that defines a first socket 105*a* on one end of the socket body 105 and a second socket 105*b* on the other end of the socket body 105. In some embodiments, one of the sockets 105*a*, 105*b* may be approximately sized as a ½" socket, while the other one of the sockets 105*a*, 105*b* may be approximately sized as a 9/16" socket. Additionally, the sidewall 105*c* defines a first channel C1 that extends through the first socket body 105 from the first socket 105*a* to the second socket 105*b*.

The second socket body 110 includes a sidewall 110*c* that defines a third socket 110*a*. In some embodiments, the third socket 110*a* is approximately sized as a ⅜" socket. The sidewall 110*c* defines a second channel C2 that extends a length of the second socket body 110 from the third socket 110*a* to an opposite end of the socket body 110. In this illustrative embodiment in FIG. 1, the opposite end of the socket body 110 includes a receiving slot 140 that is sized to retainingly but releasably engage with the second tool 100*b*, as will be discussed in more detail in the paragraphs that follow. Additionally, the sidewall 110*c* of the second socket body 110 includes a gap 110*b* that extends a length of the second socket body 110 from the third socket 110*a* to the receiving slot 140. The gap 110*b* advantageously reduces the weight and size of the tool 100*a* and can allow for easier access to larger mounting hardware than if the third socket 110*a* was formed without the gap 110*b*.

The first socket body 105 is aligned with a first axis A1 that passes centrally through the first channel C1 and the second socket body 110 is aligned with a second axis A2 that passes centrally through the second channel C2. In some embodiments, the first axis A1 is parallel to the second axis A2, and the bridge 115 is perpendicular to both the first axis A1 and the second axis A2. For example, the angle between the first axis A1 and the second axis A2 can be 0° and the angle between the first axis A1 and the bridge 115 is 90° and the angle between the second axis A2 and the bridge 115 is also 90°. In other embodiments the first axis A1 and the second axis A2 are substantially parallel so that the angle between the first axis A1 and the second axis A2 can be between about 30°, 20°, 10°, 5°, −5°, −10°, −20°, or −30°.

Advantageously, a user may repair, maintain, assemble, and/or disassemble a simple mechanical devices such as a skateboard using the different sized sockets of the first tool 100*a*, where the bridge 115 may be used as a lever arm to deliver rotational torque to a fastener engaged with one of the first socket 105*a*, the second socket 105*b*, or the third socket 110*a*.

The second tool 100*b* is generally an L-shaped tool formed from a first shaft 160 and a second shaft 165 coupled together at an angled junction 130. The angle formed between the first shaft 160 and the second shaft 165 at the angled junction 130 can be 90°. In other embodiments, the angle can be an acute angle, such as an angle of about 60°, 70°, or 80°. In still other embodiments, the angle can be an obtuse angle, such as an angle of about 100°, 110°, or 120°.

In this illustrative embodiment in FIG. 1, the first shaft 160 includes a first drive tip 125 at its distal end. The second shaft 165 includes a second drive tip 120 at its distal end. The first drive tip 125 and the second drive tip 120 can be any combination of drive tips selected from conventional drive tips, such as a flat-head screw drive tip, a crosshead style screw drive tip, commonly referred to as a PHILLIPS®-head screw drive tip, a hex-style drive tip, or a six-pointed star-shaped drive tip, commonly referred to as a TORX®-style drive tip.

Advantageously, a user may repair, maintain, assemble, and/or disassemble a simple mechanical devices such as a skateboard using the different drive tips of the second tool 100*b*, using either the first shaft 160 or the second shaft 165 as a lever arm to deliver torque to screw heads complementary with the drive tips of the second tool 100*b*.

In the non-limiting embodiment in FIGS. 1A-1K, the bridge 115 is fixedly attached to the first socket body 105 and second socket body 110. However, in alternate embodiments, the bridge 115 can be rotatably attached to either the first socket body 105, the second socket body 110, or both. For example, the rotatable connection between the first socket body 105 and the bridge 115 can allow the first socket 105*a* to move in an arcuate path towards or away from the bridge 115.

The first tool 100*a* and the second tool 100*b* can be retainingly and releasably coupled together via a receiving hole 135 passing through a width of the bridge 115 and via the receiving slot 140 disposed at an end of the second socket body 110, opposite to the third socket 110*a*. In a particular embodiment, the receiving hole 135 is sized to receive the second shaft 165 of the second tool 100*b* and the receiving slot 140 is sized to receive the first shaft 160 of the second tool 100*b*. Although not shown, either one or both of the receiving hole 135 and the receiving slot 140 can be configured with a mating surface for frictionally or mechanically engaging portions of the second tool 100*b*. For example, the mating surface can be a rubber grommet inserted within receiving hole 135 to retain the second shaft 165 of the second tool 100*b*. Additionally, a similar mating surface can be applied to the interior surface of the receiving slot 140 to frictionally or mechanically engage the first shaft 160 of the second tool 100*b*.

When the second drive tip 120 is inserted through the receiving hole 135, and when the first shaft 160 and/or the first drive tip 125 is engaged with the receiving slot 140, longitudinal, lateral, and vertical translation is reduced and/or eliminated. When the second tool 100*b* is retainingly coupled with the first tool 100*a*, the second shaft 165 can be oriented substantially parallel to axes A1 and A2, while the first shaft 160 is oriented substantially parallel to the bridge 126 and perpendicular to the axes A1 and A2.

Accordingly, the receiving hole 135 and the receiving slot 140 can allow the first tool 100*a* to be retainingly but releasably coupled to the second tool 100*b*, advantageously providing for a compact tool unit 100 that can be stored in small spaces and prevent accidental loss or misplacement of either the first or second tools 100*a*, 100*b*.

In some embodiments, the first tool 100*a* can include a blade 145 with a cutting edge exposed within the first channel C1 or the second channel C2, or both the first channel C1 and the second channel C2. For example, FIGS. 1C, 1D, 1E, 1F, and 1H depict a blade 145 that is partially exposed within the first channel C1 and/or the second channel C2. The presence of the blade 145 in these figures may be depicted in dashed lines to signify the presence of the blade if the blade is otherwise obscured by other portions of the first tool 100*a*.

FIG. 1C illustrates a side view of the multi-function tool according to various embodiments of this disclosure. The blades 145 can be seen projecting radially inward with its cutting edge aligned parallel the axes A1 and A2. In various examples, the blades 145 may have the shape of a circular segment. In some implementations, the blades 145 may have a maximum blade height at an approximate midpoint between their respective sockets and with the height of the blade substantially monotonically decreasing moving out from the midpoint of the blade's length. The blade 145 may advantageously terminate at a point such that the blade does not interfere with the functioning of the first socket 105*a* or the second socket 105*b*, or socket 110*a* when the blade 145 is disposed within channel C2.

FIG. 1D is a bottom view of the multi-function tool according to various embodiments of this disclosure, and FIG. 1E is a top view of the multi-function tool according to various embodiments of this disclosure. In the non-limiting example in FIGS. 1D and 1E, the tool 100*a* is depicted as having only a single blade 145 mounted into the first socket body 105 with its cutting edge exposed in the channel C1.

In FIG. 1D, a transition shoulder 155 can be seen which delineates the change in the cross-sectional area of the sidewall 105*c* when socket 105*b* is larger than socket 105*a*. In another embodiment, the transition shoulder 155 can be omitted in favor of an inner sidewall that transitions smoothly between the first socket 105*a* and the second socket 105*b*.

FIG. 1F illustrates an end view of the first socket body depicting a slot for receiving a blade according to various embodiments of this disclosure. The slot 150 extends in a direction from the first socket 105*a* to the second socket 105*b* and in one embodiment, the blade 145 can be inserted into the slot 150 so that the blade 145 passes partially through the sidewall 105*c* of the first socket body 105.

In a non-limiting example, when constructing the tool 100*a*, a manufacturer may cut or form the slot 150 in the socket body, insert the blade 145 into the slot 150, and then fixedly attach the blade 145 in the slot 150 using conventional techniques, such as by welding or adhesive.

In an exemplary use case, a user may insert an elongated item through the vertically extending channel C1 in the first socket body 105 to cut/splice the elongated item along its elongated axis as it is passed through the channel C1. Accordingly, the blade 145 may thus provide additional functionality to the tool 100.

FIG. 1G illustrates a close-up perspective view depicting the first socket body according to various embodiments of this disclosure. The curved cutting surface of the blade 145 is shown exposed within the channel C1 defined by the sidewall 105*c* of the first socket body 105. The inner surface of the sidewall 105*c* is shown with a transition shoulder 155 that delineates where the cross-sectional area of the first socket body 105 transitions from the first socket 105*a* to the second socket 105*b*.

FIG. 1H illustrates an end view of the second socket body depicting a receiving slot and elongated gap according to various embodiments of this disclosure. The receiving slot 140 can be defined by a pair of laterally opposing members 140*a* and 140*b* and an inner slot surface 140C. The receiving slot 140 may be shaped complementary to a cross-section of the first shaft 160 of the second tool 100*b* or the drive tip 125 located at a distal end of the first shaft 160. For example, the first shaft 160 may have a diameter D1. A minimum lateral length between respective inner surfaces of the members 140*a*, 140*b* may be a length L. The slot surface 140*c* may cross sectionally define a fractional circle having diameter D2 (e.g., at least a semi-circle). The length L may be less than or equal to the diameter D1 (L≤D1). The diameter D2 may be greater than or equal to the diameter D2 (D2≥D1).

FIG. 1I illustrates a close-up perspective view of the second socket body according to various embodiments of this disclosure. With reference to both FIGS. 1H, 1I, and 1J, which depicts a perspective end view of the multi-function tool 100, a description of coupling the first tool 100*a* and the second tool 100*b* will be provided. A user may slide the first shaft 160 into the receiving slot 140 to (at least partially) retainingly couple the second tool 100*b* with the first tool 100*a*. In cases where a user pushes the first shaft 160 in a direction towards the receiving slot 140 and down between the members 104*a*, 104*b*, the members 140*a*, 140*b* and/or the first shaft 160 may deform slightly (e.g., due to compressive forces of the inner surfaces of the members 140*a*, 140*b* around the shaft). Once the first shaft 160 is fully inserted into the receiving slot 140, the shaft may beneficially be retainingly held in place by virtue of the relationship between length L, diameter D1, and diameter D2. For example, if the length L is slightly less than D1 (e.g., on the order of a few millimeters), then the first shaft 160 may "snap" into the receiving slot 140, and be held in place by the members 140*a*, 140*b* and the slot surface 140*c*, until a user imparts sufficient force to the tool 110*b* to remove it from the receiving slot 140. In this sense, the first shaft 160 may fit snugly into the receiving slot 140, while being retainingly held in place by the members 140*a*, 140*b*. When the drive tip 120 is also inserted through the receiving hole 135, the receiving hole 135 and the receiving slot 140 may cooperate to form two distinct anchor points that cooperate together to retainingly couple the second tool 100*b* with the first tool 100*a*. In some examples, the bridge 115 or other part of the first tool 100*a* may include a magnet.

Figure 1K:
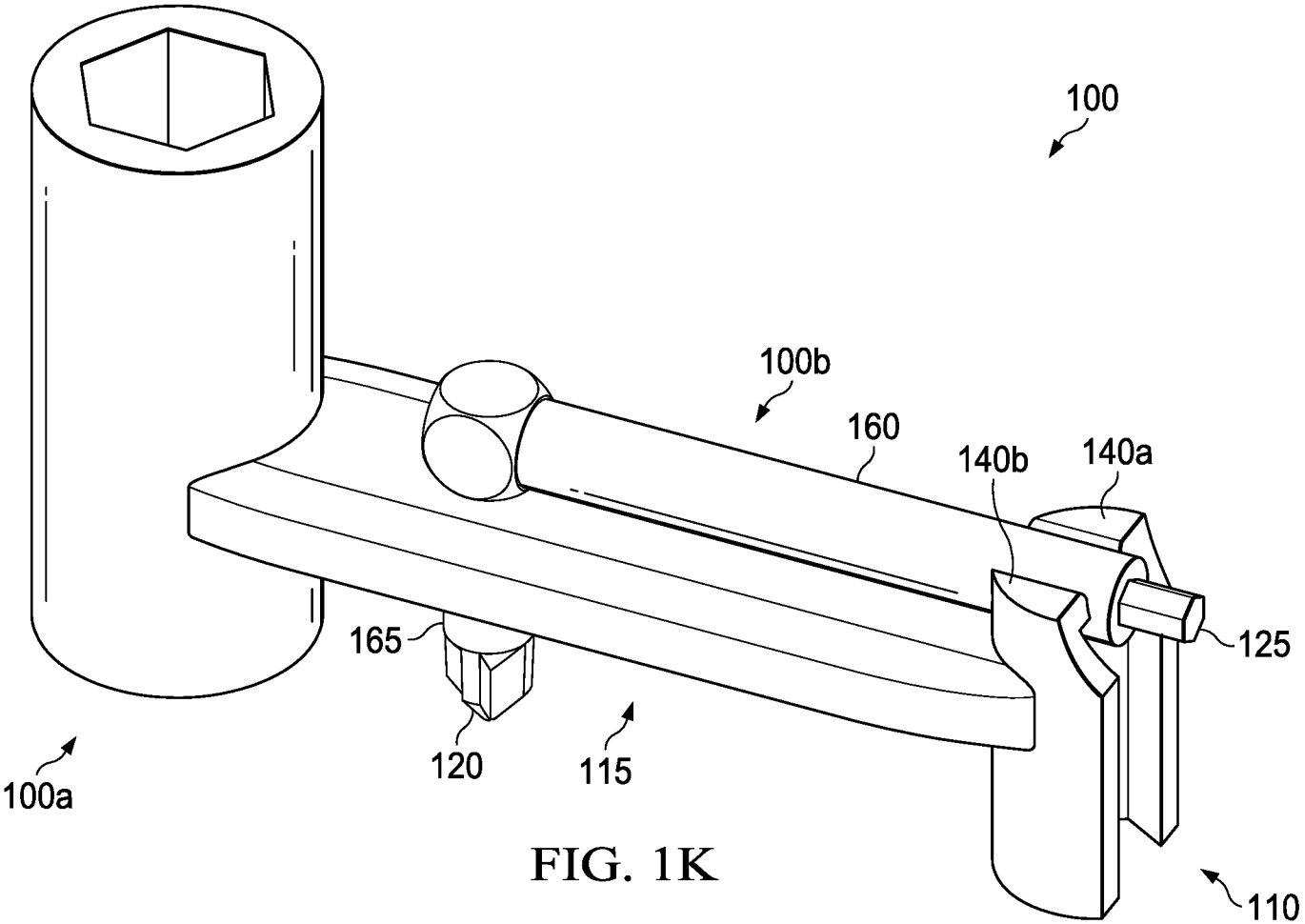
FIG. 1K illustrates another perspective view depicting the multi-function tool in an engaged configuration according to various embodiments of this disclosure.

FIG. 1K illustrates another perspective view depicting the multi-function tool in an engaged configuration according to various embodiments of this disclosure. The drive tip 120 on the second shaft 165 has been inserted through the receiving hole 135 and the first shaft 160 has been inserted into the receiving slot 140 so that the first shaft 160 can be securely held in place by the cooperation of the opposing lateral members 140*a*, 140*b* and inner slot surface 140*c*.

Figure 2A:
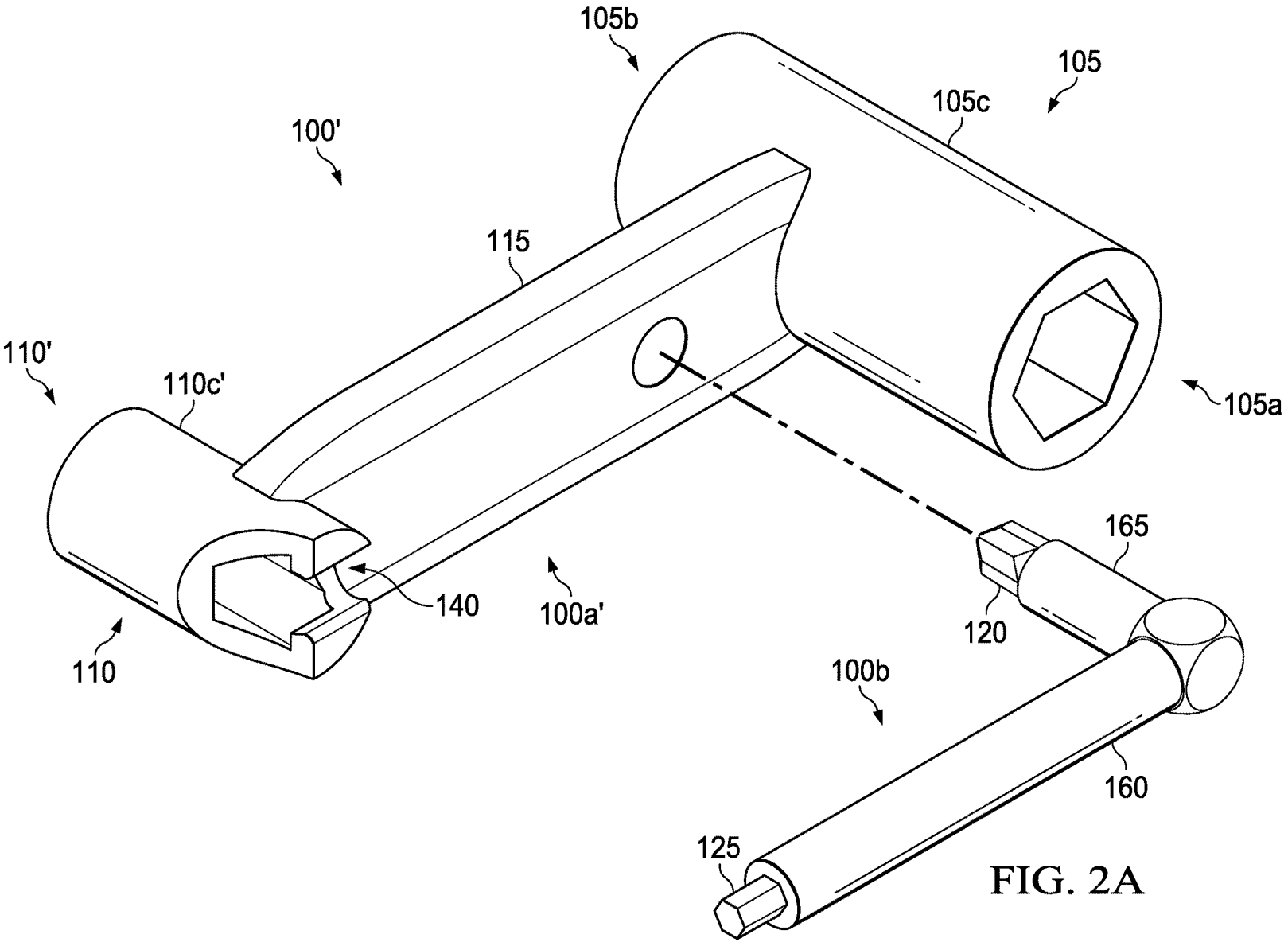
FIG. 2A illustrates a perspective view of a variation of the multi-function tool in a disengaged configuration according to various embodiments of this disclosure.
Figure 2B:
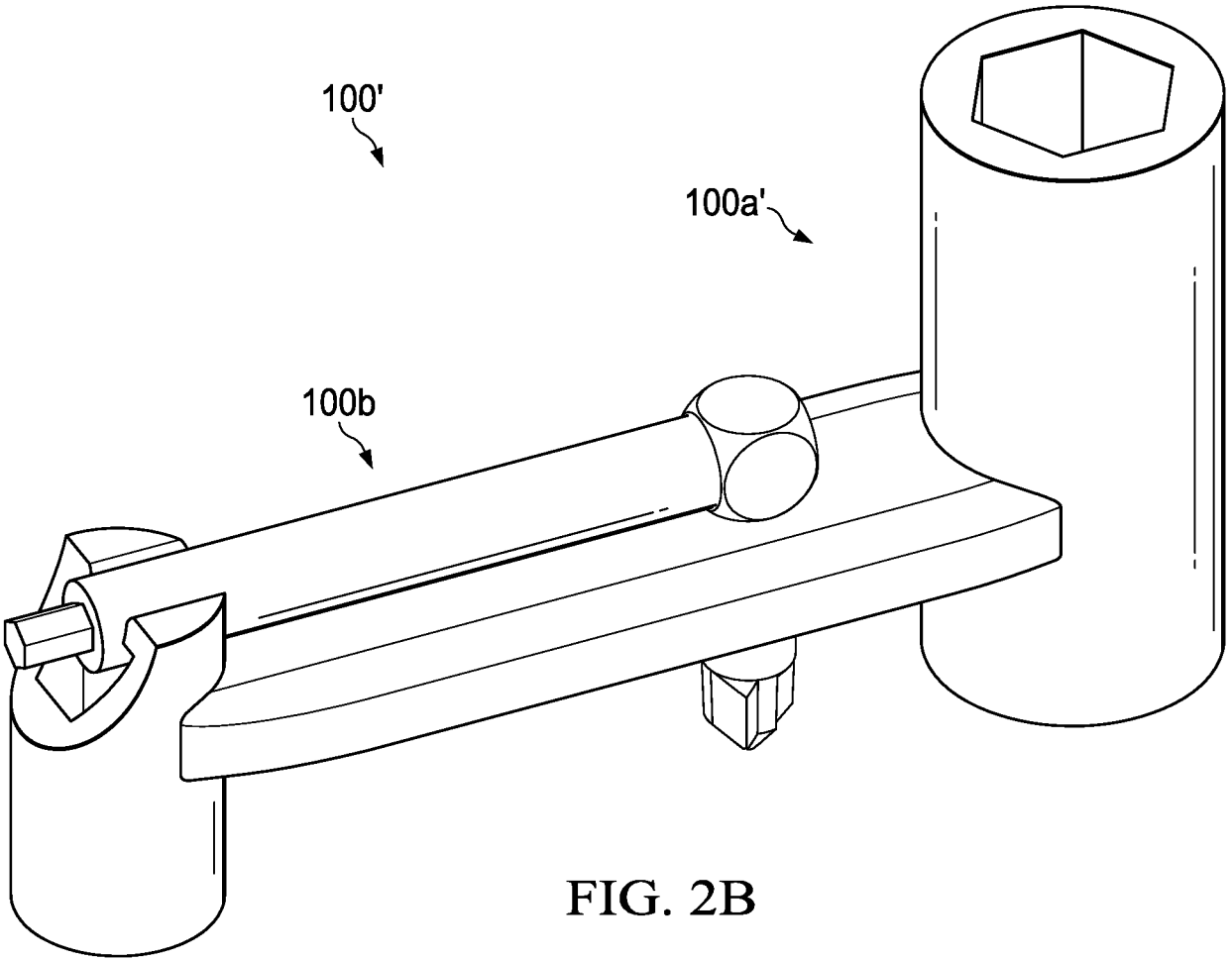
FIG. 2B illustrates a perspective view of the multi-function tool in an engaged configuration according to various embodiments of this disclosure.

FIG. 2A illustrates a perspective view of a variation of the multi-function tool in a disengaged configuration according to various embodiments of this disclosure. The multi-function tool 100' includes a first tool 100*a*' and a second tool 100*b* that can be removably coupled to the first tool 100*a*' to achieve the engaged configuration shown in FIG. 2B. The manner in which the first tool 100*a*' and the second tool 100*b* can be retainingly and releasably coupled together is described in detail in FIG. 1 and will be omitted for the sake of brevity.

The first tool 100*a*' is similar to the first tool 100*a* depicted in FIG. 1 with the exception of the second socket body 110', which lacks the gap 110*b* extending the length of the second socket body 110' from the third socket 110*a* to the receiving slot 140. Advantageously, the uninterrupted sidewall 110*c*' of the second socket body 110' is capable of withstanding greater stresses than the sidewall 110*c* of the tool 100*a* in FIG. 1 and may be preferred in some applications.

FIGS. 3A-3E illustrate different views of another variation of the multi-function tool according to various embodiments of this disclosure. The multi-function tool 100" includes a first tool 100*a*" and a second tool 100*b*" as described in more detail in the paragraphs that follow.

Figure 3A:
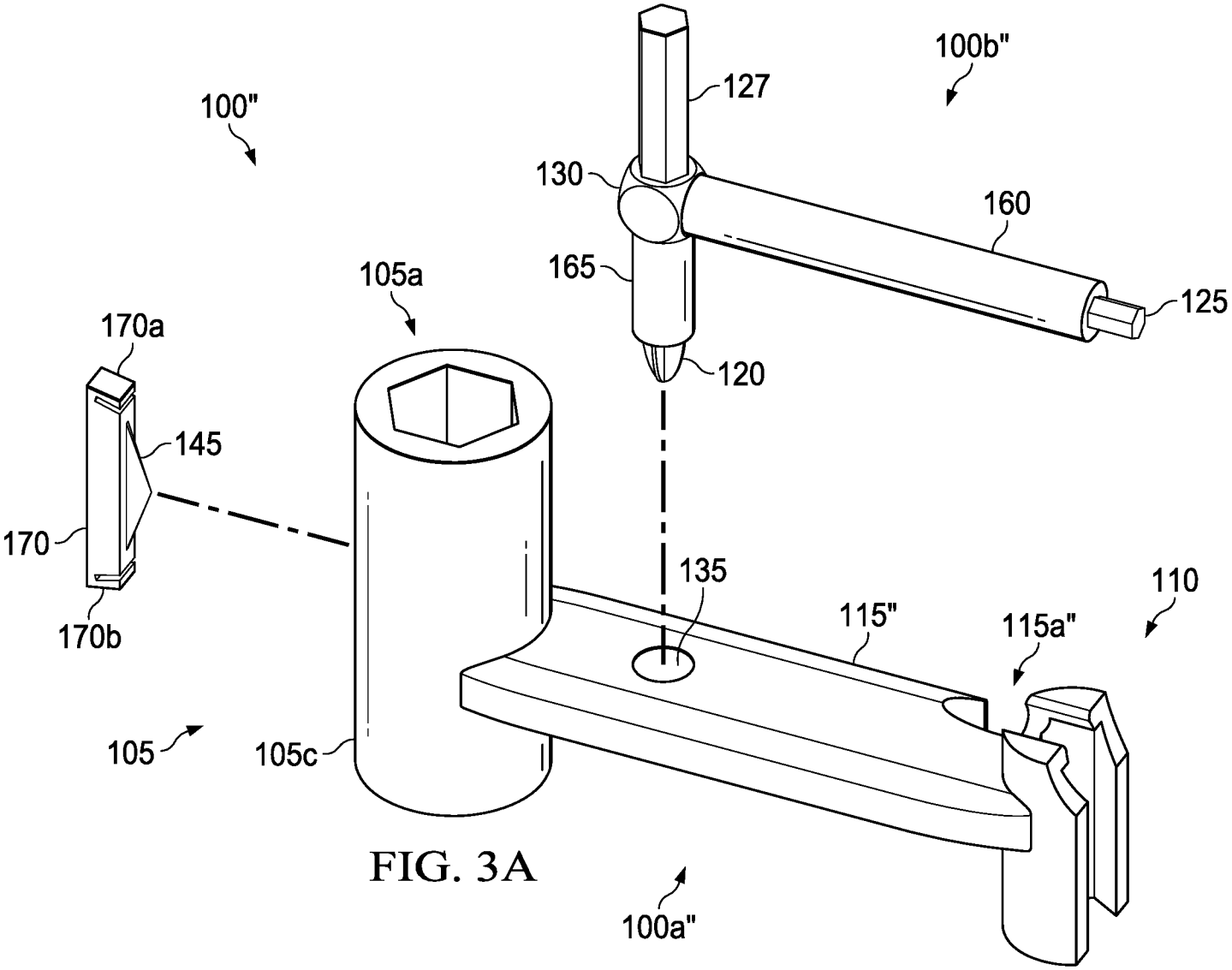
FIG. 3A illustrates a perspective view of another variation of the multi-function tool according to various embodiments of this disclosure.
Figure 3B:
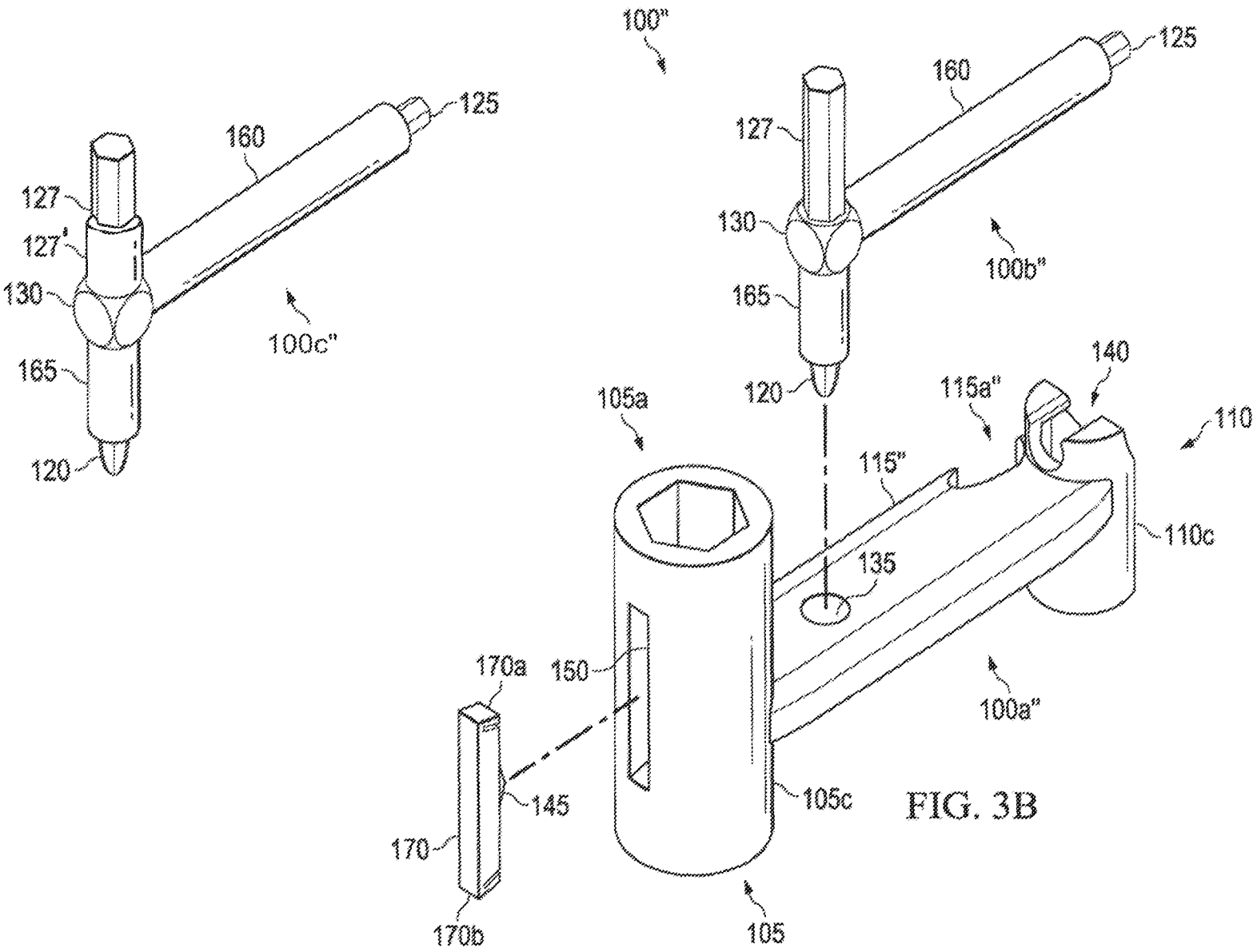
FIG. 3B illustrates another perspective view of the multi-function tool according to various embodiments of this disclosure.

FIGS. 3A and 3B illustrate a perspective views of the multi-function tool according to another embodiment. The first tool 100*a*" includes a first socket body 105 coupled to a second socket body 110 by an elongated bridge 115". Formed into the elongated bridge 115" is a lever 115*a*" that can be used as a pry tool. In this non-limiting embodiment, the lever 115*a*" is formed by a void space defined in the bridge 115". In an exemplary use case, the lever 115*a*" can be used as a bottle opener. The first tool 100*a*" also includes a blade 145 that is embedded within a base 170. At either ends of the base 170 are flexible tabs 170*a* and 170*b* for securing the base 170 within a slot 150 formed into the sidewall 105*c* of the first socket body 105. In one embodiment, depressing either of the flexible tabs 170*a* or 170*b* from within the channel C1 releases the base 170 from the slot 150, which allows the blade 145 to be replaced.

The second tool 100*b*" is generally a T-shaped tool formed from a first shaft 160 with a first drive tip 125 disposed at its distal end, a second shaft 165 with a second drive tip 120 disposed its distal end, and a third elongated drive tip 127 extending from the angled junction 130. The angle formed between the first shaft 160 and the second shaft 165 at the angled junction 130 can be 90° and the angle formed between the second shaft 165 and the elongated drive tip 127 can be 180°. In other embodiments, the angle between the second shaft 165 and the elongated drive tip 127 can be 180° while the angle between the second shaft 165 and the first shaft 160 can be an acute angle, such as an angle of about 60°, 70°, or 80°. In still other embodiments, the angle between the second shaft 165 and the first shaft 160 can be an obtuse angle, such as an angle of about 100°, 110°, or 120°.

In another embodiment of FIG. 3, the T-shaped second tool can include a third shaft 127' extending from the angled junction with the third drive tip 127 disposed at the distal end of the third shaft 127', as shown in 100*c*". When sized similarly with the second shaft 165, either the second shaft 165 or the third shaft 127' can be inserted into the receiving hole 135 of the bridge 115" to couple the first tool 100*a*" to the second tool 100*c*".

Figure 3C:
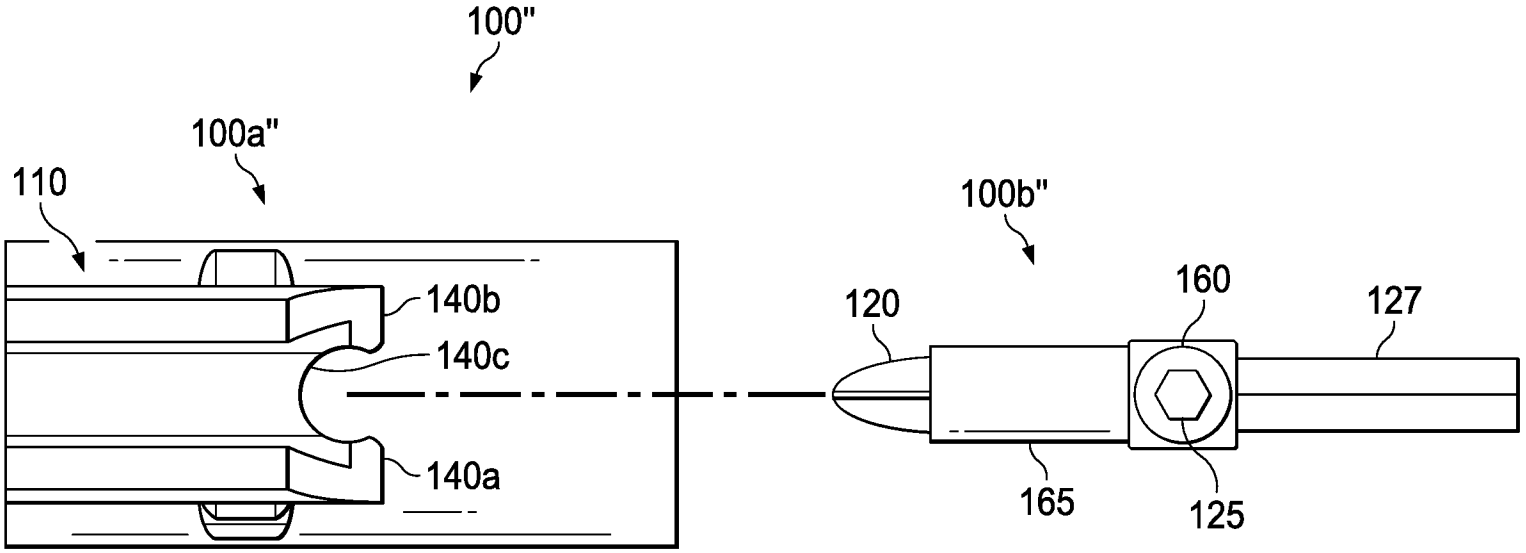
FIG. 3C illustrates an end view of the multi-function tool according to various embodiments of this disclosure.
Figure 3D:
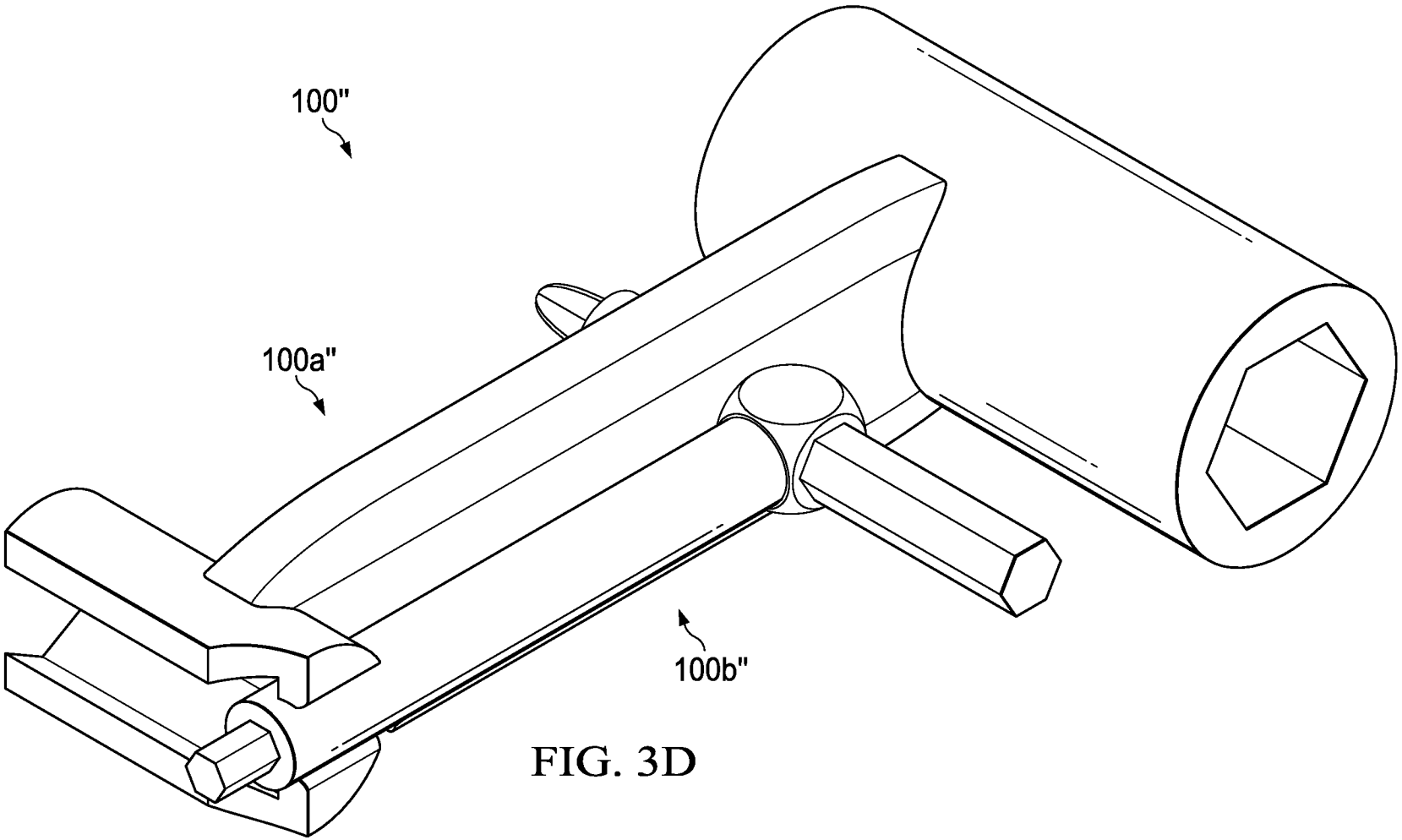
FIG. 3D illustrates a perspective view of the multi-function tool in an engaged configuration according to various embodiments of this disclosure.
Figure 3E:
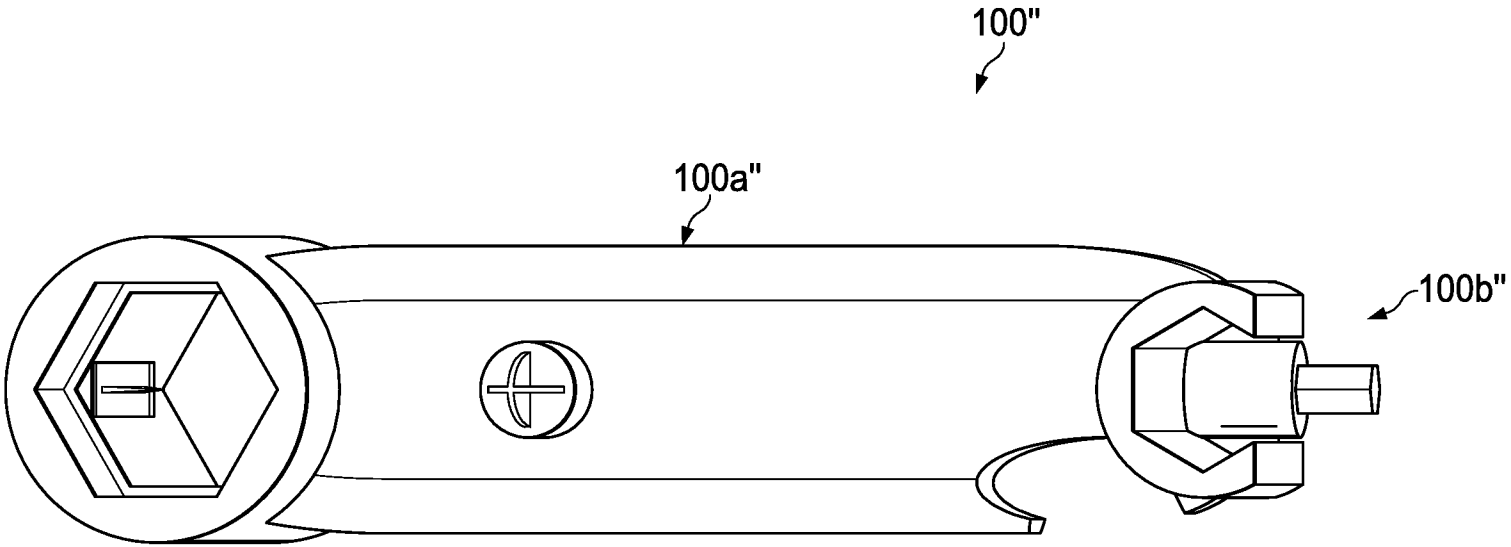
FIG. 3E illustrates another perspective view of the multi-function tool in an engaged configuration according to various embodiments of this disclosure.

FIG. 3C illustrates an end view of the multi-function tool from according to various embodiments of this disclosure. The second tool 100*b*" can be retainingly coupled with the first tool 100*a*" as described in more detail in FIGS. 1A-1K above to achieve the engaged configuration of the multi-function tool 100" depicted in various perspective views shown in FIGS. 3D and 3E.

The various embodiments of the multi-function tool described herein can be formed from a rigid material, such as metal or plastic, using conventional fabrication techniques. For example, the multi-function tool can formed from a mould or from three-dimensional printing.

Although this disclosure has been described with an exemplary embodiment, various changes and modifications may be suggested to one skilled in the art. It is intended that this disclosure encompass such changes and modifications as fall within the scope of the appended claims. For example, although exemplary drive tip shapes and socket shapes may be disclosed, various embodiments may employ different types of drive tip shapes and/or socket shapes to engage other fasteners, such as screws and bolts, for example.

What is claimed is:

1. A multi-function tool comprising: a first socket body comprising a first sidewall defining a first socket within a first end of the first socket body and a second socket, different than the first socket, within a second end of the socket body opposite the first end, wherein the first socket body is aligned with a first axis;

a second socket body comprising a second sidewall defining a third socket within a first end of the second socket body and different than the first and second sockets, wherein the second socket body is aligned with a second axis;

a blade comprising a cutting edge; and a bridge extending along a longitudinal axis and connecting the first sidewall of the first socket body to the second sidewall of the second socket body at opposing ends, wherein the first axis is substantially parallel to the second axis and the longitudinal axis is substantially perpendicular to both the first axis and the second axis, wherein the bridge includes a receiving hole passing through from one side of the bridge to the other side of the bridge through the longitudinal axis, and wherein the second socket body comprises a receiving slot at an end opposite to the third socket and aligned substantially parallel with the longitudinal axis of the bridge;

wherein:

the bridge is configured to deliver rotational torque to a fastener engaged within one of the first socket, the second socket, or the third socket, the multi-function tool further comprises a second tool comprising a first shaft sized to releasably engage the receiving slot and a second shaft extending from the first shaft at an angled junction, the second shaft being sized to pass at least partially through the receiving hole in the bridge, and the first sidewall defines a first channel extending through the first socket body from the first socket to the second socket, wherein the first sidewall includes a slot aligned substantially parallel to the first axis, wherein the blade is disposed within the slot with the cutting edge exposed within the first channel, and wherein the blade is aligned substantially parallel to the first axis.

2. The multi-function tool of claim 1, wherein the receiving slot further comprises a pair of opposing members and an inner slot surface forming a mating surface for receiving the first shaft.

3. The multi-function tool of claim 1, wherein the second tool comprises a set of drive tips, and wherein at least one of the set of drive tips is a crosshead-style screw drive tip, a flat-head screw drive tip, a six-pointed star-shaped screw tip, and/or a hex-style drive screw tip.

4. The multi-function tool of claim 3, wherein the second tool is an L-shaped tool, and wherein the set of drive tips comprises a first drive tip at an end of the first shaft and a second drive tip at an end of the second shaft.

5. The multi-function tool of claim 3, wherein the second tool is a T-shaped tool comprising a first drive tip at an end of the first shaft, a second drive tip at an end of the second shaft, and a third drive tip extending away from the angled junction and substantially parallel with the second shaft.

6. The multi-function tool of claim 3, wherein the second tool further comprises a third shaft coupled to the angled junction, and wherein the third drive tip is disposed at an end of the third shaft.

7. The multi-function tool of claim 1, wherein the bridge comprises a void space defining a lever.

8. The multi-function tool of claim 1, wherein the blade is fixedly mounted on a base sized to fit within the slot, and wherein the base is releasably engaged within the slot.

9. The multi-function tool of claim 8, wherein the base comprises a set of flexible tabs for releasably engaging the slot.

10. The multi-function tool of claim 1, wherein the second sidewall of the second socket body defines a second channel extending from the third socket to an opposite end of the second socket body.

11. The multi-function tool of claim 10, wherein the second sidewall of the second socket body defines a gap aligned substantially parallel to the second axis, and wherein the gap extends from the third socket to the opposite end of the second socket body.

12. The multi-function tool of claim 10, wherein the blade is aligned substantially parallel to the second axis.

13. The multi-function tool of claim 1, wherein at least one of the first socket, the second socket, and the third socket is a ½ inch socket, a 9/16 inch socket, or a ⅜ inch socket.

14. A multi-function tool comprising:

a first socket body comprising a first sidewall defining a first socket within a first end of the first socket body and a second socket, different than the first socket, within a second end of the socket body opposite the first end, wherein the first socket body is aligned with a first axis;

a second socket body comprising a second sidewall defining a third socket within a first end of the second socket body, wherein the second socket body is aligned with a second axis;

a bridge extending along a longitudinal axis and connecting the first sidewall of the first socket body to the second sidewall of the second socket body at opposing ends, wherein the first axis is substantially parallel to the second axis and the longitudinal axis is substantially perpendicular to both the first axis and the second axis;

a detachable tool comprising a first shaft and a second shaft;

a blade comprising a cutting edge; and wherein the second socket body comprises a receiving slot at an end opposite to the third socket and aligned substantially parallel with a longitudinal axis of the bridge, the receiving slot sized to releasably receive therein said first shaft of said detachable tool, wherein the bridge includes a receiving hole passing through from one side of the bridge to the other side of the bridge and sized to receive therein a tip of said second shaft of the detachable tool, and wherein the first sidewall defines a first channel extending through the first socket body from the first socket to the second socket, wherein the first sidewall includes a slot aligned substantially parallel to the first axis, wherein the blade is disposed within the slot with the cutting edge exposed within the first channel, and wherein the blade is aligned substantially parallel to the first axis.

15. The multi-function tool of claim 14, wherein the receiving slot further comprises a pair of opposing members and an inner slot surface forming a mating surface for receiving the first shaft and releasably securing the first shaft to the receiving slot.

16. The multi-function tool of claim 14, wherein the first shaft and the second shaft of the detachable tool are joined at an angled junction.

17. The multi-function tool of claim 16, wherein the detachable tool further comprises a third shaft coupled to and extending from the angled junction, and including a drive tip disposed at an end of the third shaft.

* * * * *